US005122627A

United States Patent [19]

Trana

[11] Patent Number: 5,122,627

[45] Date of Patent: Jun. 16, 1992

[54] ASYMMETRICAL ELECTRICAL SWITCH ACTUATOR

[75] Inventor: Roger M. Trana, Bothell

[73] Assignee: John Fluke Mfg. Co., Inc., Everett, Wash.

[21] Appl. No.: 664,633

[22] Filed: Mar. 4, 1991

[51] Int. Cl.[5] ..... H01H 15/02; H01H 19/46

[52] U.S. Cl. ..... 200/548; 200/547; 200/519

[58] Field of Search ..... 200/548, 547, 564, 565, 200/336, 329, 324, 325, 332.2, 293.1, 291, 519, 521, 178

[56] References Cited

U.S. PATENT DOCUMENTS 5,012,056 4/1991 Abel et al. ..... 200/329 X

FOREIGN PATENT DOCUMENTS 304539 12/1988 Japan ..... 200/547

*Primary Examiner*—Henry J. Recla

*Assistant Examiner*—David J. Walczak

*Attorney, Agent, or Firm*—Seed and Berry

[57] ABSTRACT

An actutator for a multiple-position electrical switch includes an actuator member having a cam surface formed on its undersurface along each edge. Two pairs of cam followers formed at the end of respective resilient beams slide along the cam surface. The cam surface is formed with a series of ridges and indentations corresponding to the actuator switch positions. Thus, the actuator member can be moved between adjacent switch positions only by exerting sufficient force to lift each of the cam followers over a ridge from one indentation to the adjacent indentation. An additional cam follower is resiliently biased against an additional cam surface formed on the underside of the actuator member when the actuator member is moved to one switch position. As a result, the forces required to move the actuator member to one switch position is greater than the force required to move the actuator member between other switch positions.

23 Claims, 4 Drawing Sheets

ASYMMETRICAL ELECTRICAL SWITCH ACTUATOR

DESCRIPTION

1. Technical Field

This invention relates to electrical switches, and more particularly to an actuating mechanism for mechanically coupling an electrical switch to a manually accessible actuator member and for controlling the force required to actuate the switch between several switch positions.

2. Description of the Prior Art

Multiple position electrical switches have been used in a wide variety of applications. Typical multiple position switches are rotary switches and linear slide switches. Rotary switches generally utilize a circular actuator member that is rotated through several discrete angles each of which corresponds to a switch position. Similarly, linear multiple position slide switches utilize an actuator member that is moved linearly through several discrete positions each of which corresponds to a switch position.

Conventional multiple position switches are suitable for most applications. However, for some applications they leave much to be desired. For example, when using electrical devices employing such switches, it is often necessary to switch back and forth between two or more positions without inadvertently switching to another switch position. In some cases, different switch positions may cause the electrical device to perform different functions while one switch position switches the electrical device off. If the switch is inadvertently actuated to the off position when the user is attempting to alter the function by switching between other switch positions, data stored in volatile memory in the device can be inadvertently lost. Thus, there has been an unfulfilled need for an actuating mechanism for a multiple position switch that has a different tactile feel when attempting to switch to one position, such as the off position, than when switching between other positions.

Another problem with many conventional multiple position switches is that they utilize detent mechanisms that are relatively complex because they are composed of a fairly large number of separate parts many of which are movable. The complexity of these structures makes such multiple position switches relatively bulky, expensive and trouble prone. Such switch actuators are not suitable for use in applications where a high degree of compactness is desired. Nor are such actuators suitable for mass produced consumer goods in which low price is of paramount importance, nor are they suitable for use where reliability is important. Therefore, an unfulfilled need has existed for a multiple position switch actuator that is inexpensive, compact and trouble free.

SUMMARY OF THE INVENTION

It is an object of the invention to provide an actuator for a multiple position electrical switch that requires more force to move the switch to one position than it does to move the switch to other positions.

It is another object of the invention to provide an actuator for a multiple position electrical switch that utilizes only one moving part thus making the actuator inexpensive and trouble free.

It is still another object of the invention to provide an actuator for a multiple position electrical switch that is relatively compact.

It is a further object of the invention to provide an actuator for a multiple position electrical switch that can be easily adapted to a variety of switch configurations and to different numbers of switch positions and switch position spacings.

These and other objects of the invention are provided by an actuator for an electrical switch having at least three switch positions. The actuator includes a support and an actuator member slidably mounted on the support. The actuator includes a first detent mechanism for resiliently biasing the actuator member against movement to each of the switch positions. A second detent mechanism resiliently biases the actuator member against movement to less than all of the switch positions, such as a single switch position. As a result, the force required to move the actuator member to a switch position against only the first detent mechanism is less than the force required to move the actuator member to a switch position against both detent mechanisms. The detent mechanisms preferably each include an elongated cam surface formed on an underside of the actuator member and a resilient beam extending from the support and terminating in a respective cam follower which contacts each of the cam surfaces. Indentations or ridges are formed on each of the cam surfaces. The cam follower of the first detent mechanism passes over a ridge on its cam surface from one indentation to an adjacent indentation each time the actuator moves from switch position to another switch position. In contrast, the cam follower of the second detent mechanism passes over a ridge on its cam surface from one indentation to another only when the actuator member is moved between some, but not all, switch positions. The first detent mechanism preferably includes a pair of parallel cam surfaces each of which is contacted by a pair of cam followers mounted on respective resilient beams. The cam surfaces on the actuator and the cam followers extending from the support are preferably symmetrical so that the actuator may be mounted on the support in either direction.

DETAILED DESCRIPTION OF THE PREFERRED EMBODIMENT

Figure 1:
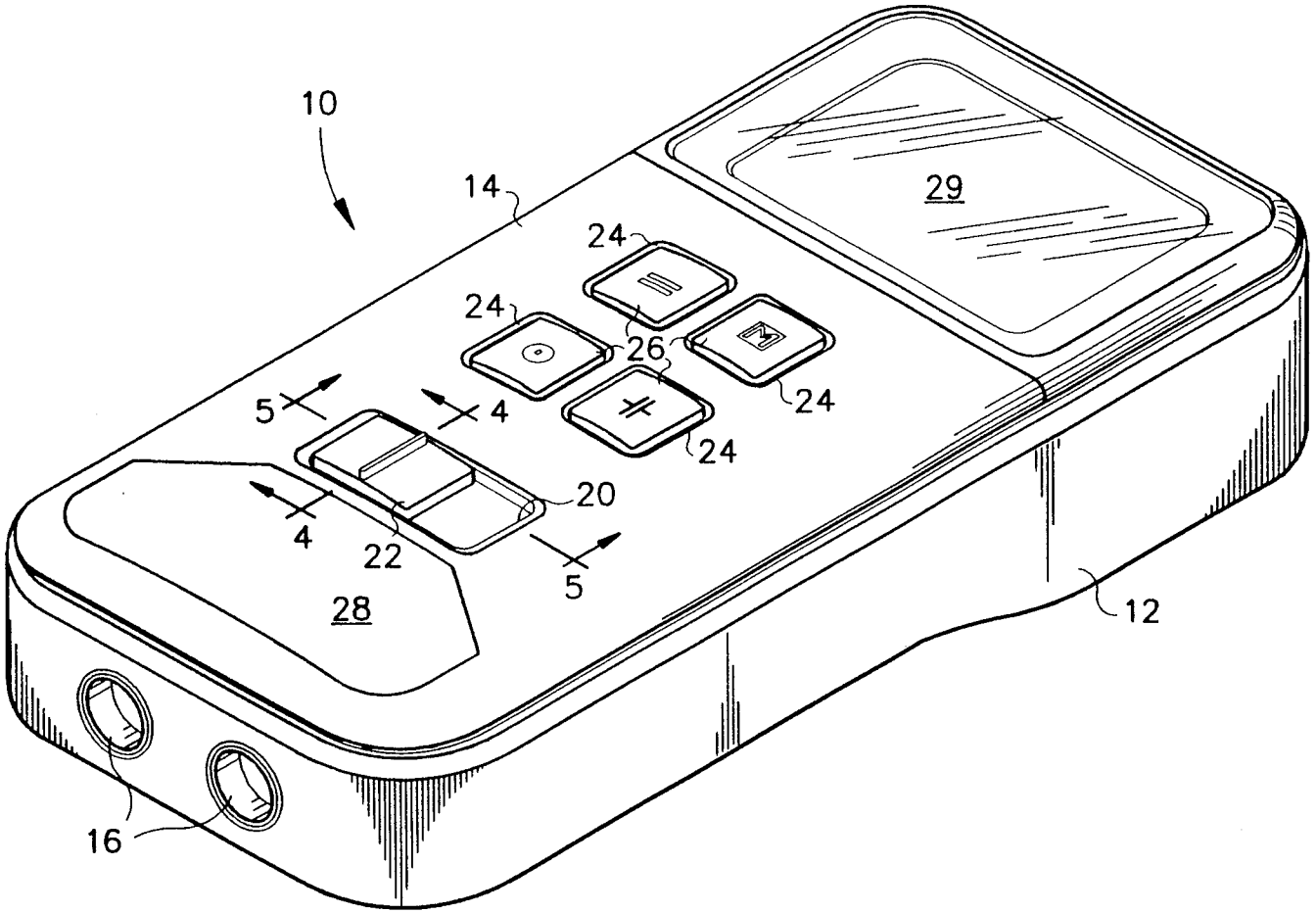
FIG. 1 is an isometric view of an electronic multimeter utilizing the inventive multiple pole electrical switch actuator.

The inventive multiple position electrical switch actuator is shown used in an electronic multimeter 10 in FIG. 1. As is well known in the field, the electronic multimeter 10 is used to perform a variety of electrical measurements such as measuring voltage, current, resistance, capacitance and the like. The multimeter 10 includes a case 12 of generally rectangular configuration having a rectangular coverplate 14. A pair of cylindrical apertures 16 formed in one end wall of the case 12 receives respective test leads for making electrical connection to the signal or circuit node to be measured.

The case has formed therein an elongated rectangular cut-out 20 through which a portion of an actuator member 22 projects. As explained in greater detail below, the actuator member 22 is movable between three positions, namely a leftmost "off" position, as well as center and rightmost positions that control the operation of the multimeter 10. In operation, the actuator 22 is frequently switched between the center and rightmost positions to alter the operation of the multimeter 10. After the multimeter has made at least one measurement, data indicative of that measurement is stored in volatile memory in the multimeter 10. Inadvertent movement of the actuator 22 to the leftmost "off" position would cause this data to be lost. It is therefore important that greater force be required to move the actuator 22 to the leftmost position than is required to move the actuator 22 between the center and rightmost position. Thus, an asymmetrical tactile feel is important to allow the actuator to be moved back and forth between two or more switch positions without allowing the actuator to be inadvertently moved to another switch position, such as the "off" position illustrated in FIG. 1.

It is most desirable that the asymmetrical tactile feel of the actuator be provided by a mechanism that is inexpensive so that the multimeter 10 can be sold for a competitive price. It is also important that the actuator be compact so that it does not unduly add to the width or thickness of the multimeter 10. Finally, the actuator should be trouble free to minimize warranty claims and promote customer satisfaction.

The cover 14 also includes four square cutouts 24 through which respective operating keys 26 project. The keys 26 control the operation of the multimeter 10 along with the switch controlled by the actuator 22 in accordance with information printed on a panel 28 at the bottom of the cover 14. Finally, an alphanumeric display 29 of conventional design, such as liquid crystal ("LCD") appears through a rectangular opening at the top of the cover 14.

Although the inventive multiple position electrical switch actuator has been shown for use with a multimeter 10, it will be understood that it can be advantageously used in any type of electrical device using a multiple position switch. However, it is most advantageously used in applications where minimum expense, small size and reliable operation are desired.

Figure 2:
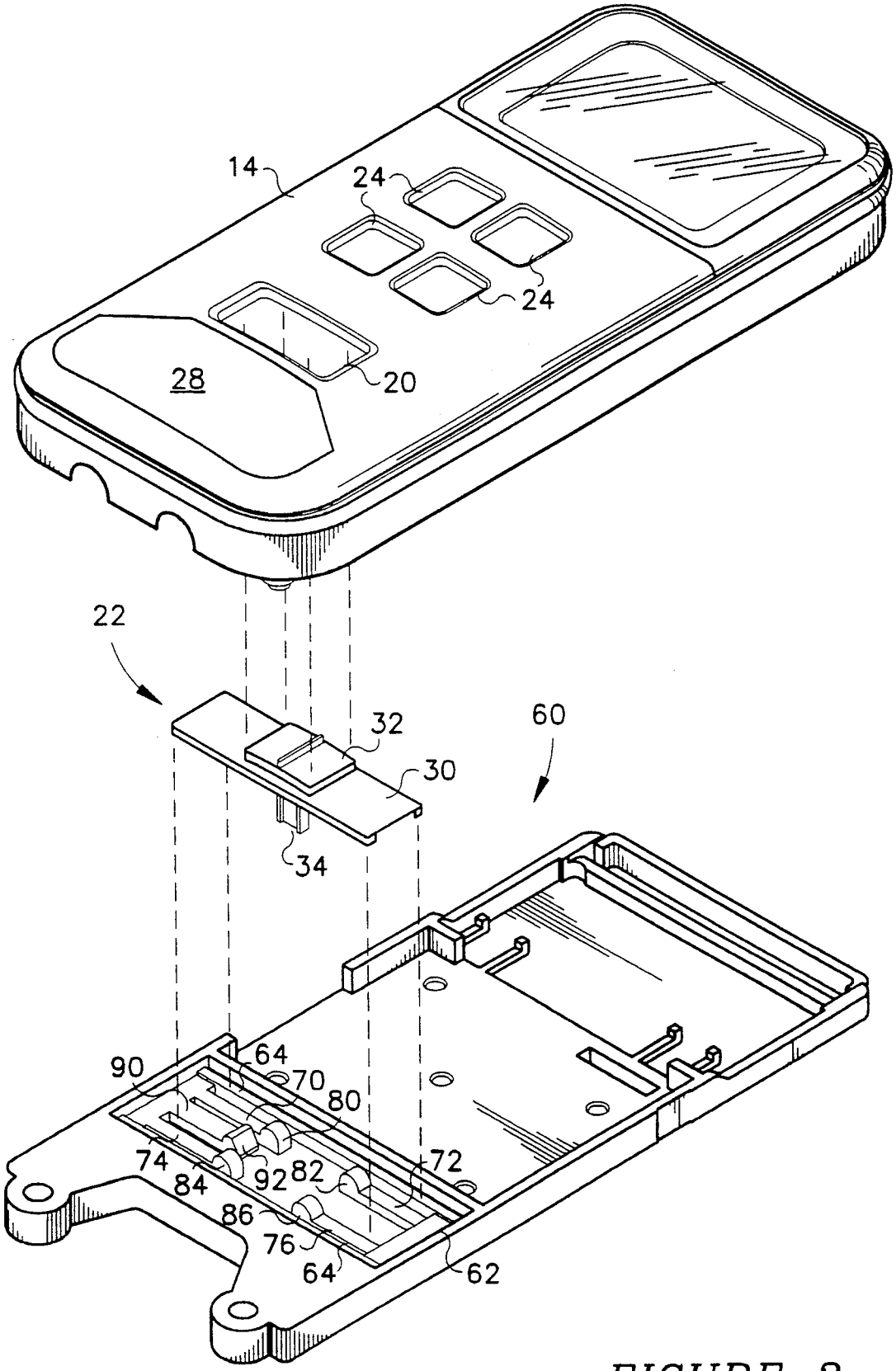
FIG. 2 is an exploded isometric view of a portion of the multimeter of FIG. 1.
Figure 3:
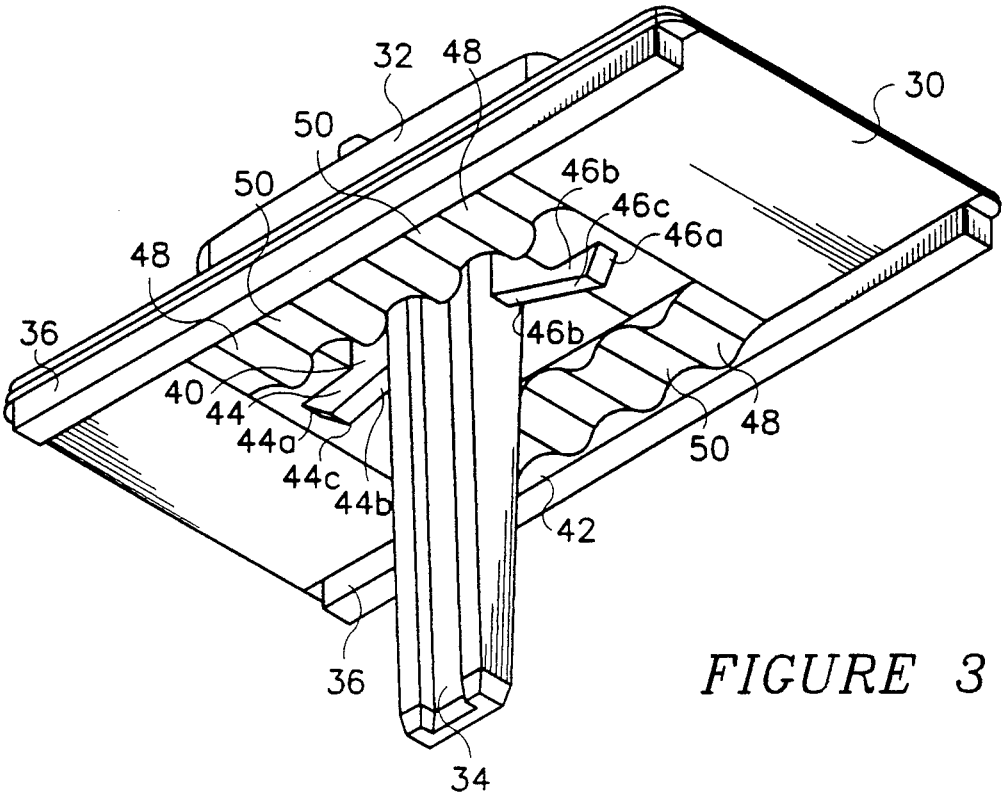
FIG. 3 is an isometric view of the underside of an actuator member used by the inventive actuator.

The internal structure of the inventive actuator is best illustrated in FIGS. 2 and 3. The actuator member 22 includes a generally rectangular base plate 30 having a smaller rectangular projection 32 extending upwardly through the aperture 20 in the cover 14. The underside of the base plate 30 includes a downwardly extending post 34 (FIG. 3) adapted to mate with the slide of a multiple position switch. A pair of rails 36 extend along respective sides of the base plate 30. Two cam surfaces 40, 42 are formed on each side of the post 34, and a pair of ramps 44, 46, respectively, are formed at the center of the base plate 30 on opposite sides of the post 34.

The cam surfaces 40, 42 each includes four ridges 48 separated from each other by a respective indentation 50. As explained below, at least one cam follower is resiliently biased against each cam surface 40, 42 so that they must travel over the ridges 48 to be captured by the indentations 50 each time the actuator member 22 changes switch positions.

The ramps 44, 46 formed at the center of the base plate 30 are each composed of two ramp surfaces, 44*a,b* and 46*a,b*, respectively, intersecting each other to form respective ridges 44*c*, 46*c*. The ramp surfaces 44*a*, 46*a* facing the respective ends of the base plate 30 are steeper than the other ramp surfaces 44*b*, 46*b*. As explained below, this configuration results in more force being required to switch the actuator member 22 from the center position to the leftmost position than is required to switch the actuator member from the leftmost position to the center position.

Figure 4:
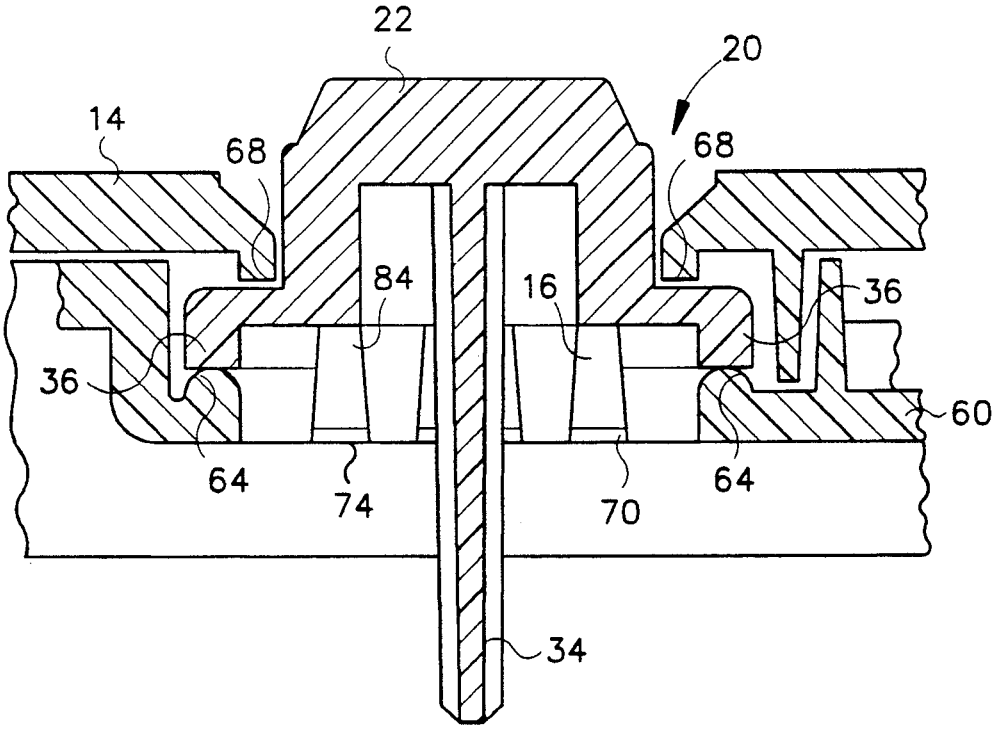
FIG. 4 is a cross-sectional view taken along the line A—A of FIG. 1.

The multimeter 10 also includes a support 60 (FIG. 2) having a rectangular recessed portion 62 which forms a portion of the actuator. More specifically, the actuator member 22 is mounted within the recessed portion 62, as best illustrated in FIG. 4. With reference to FIG. 4, the actuator member is mounted on the support 60 with the rails 36 of the actuator member 22 resting on support rails 64 (FIGS. 2 and 4) extending along opposite sides of the recessed portion 62. The actuator 22 can thus slide within the recessed portion 62 between the several switch positions.

It will also be apparent from FIG. 4 that the cover 14 is used to capture the actuator member 22 and hold it in contact with the support rails 64. As illustrated in FIG. 4, a pair of downwardly depending retaining rails 68 extend transversely across the cover 14 on opposite sides of the cutout 20. The retaining rails 68 contact the upper surface of the base plate 30 thereby holding the rails 36 against the support rails 64. By capturing the actuator member 22 and holding it in contact with the support rails 64, the actuator member 22 is not able to move vertically as it is manually actuated from one switch position to another. This inability to move vertically provides the actuator with a solid, high quality "feel" during use.

The lower surfaces of the retaining rails 68 are preferably straight even though the cover 14 may bow upwardly at the center. Thus, the retaining rails 68 not only retain the actuator member 22 in position, but they allow the actuator member 22 to move linearly even though the cover 14 is curved.

With reference to FIGS. 2 and 4, four resilient beams 70–76 integrally formed with the support 60 extend from the ends of the recessed portion 62 toward each other in a symmetrical manner. The resilient beams 70–76 terminate in respective, upwardly facing cam followers 80, 86. A fifth resilient beam 90, also terminating in a cam follower 92, projects from one end of the recessed portion 62 between the resilient beams 70, 74. As explained in greater detail below, the cam followers 84, 86 on one side of the recessed portion 62 contact the cam surface 40 (FIG. 3), the cam followers 80, 82 on the other side of the recessed portion 62 contact the cam surface 42 and the cam surface 92 contacts either one of the ramps 44, 46 depending upon which direction the actuator member 22 is placed in the recessed portion 62.

Figure 5:
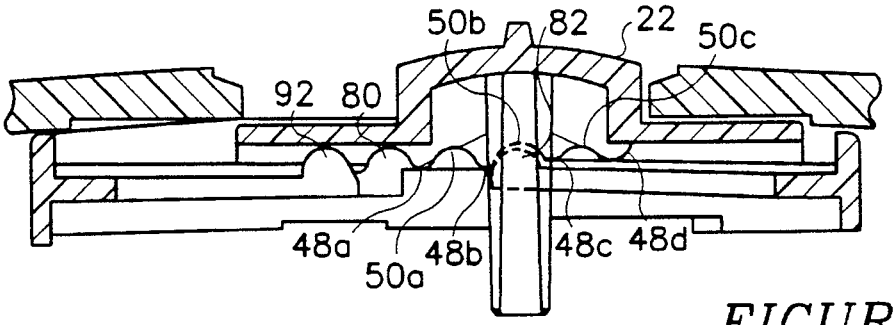
FIG. 5 is a cross-sectional view taken along the line B—B of FIG. 1 showing the actuator in its rightmost position.

The operation of the inventive actuator and the manner in which the force required to move the actuator member 22 is made asymmetrical is best illustrated with reference to FIGS. 5–8. With reference, now, to FIG. 5, the actuator member 22 is shown in its rightmost position. In this position, the cam follower 82 is positioned within the center of indentation 50*b* of the cam surface 40 and is captured by the adjacent ridges 48*b,c*. The other cam follower 80 is positioned adjacent the ridge 48*a*. The cam follower 92 is not yet in contact with the ramp 44.

Figure 6:
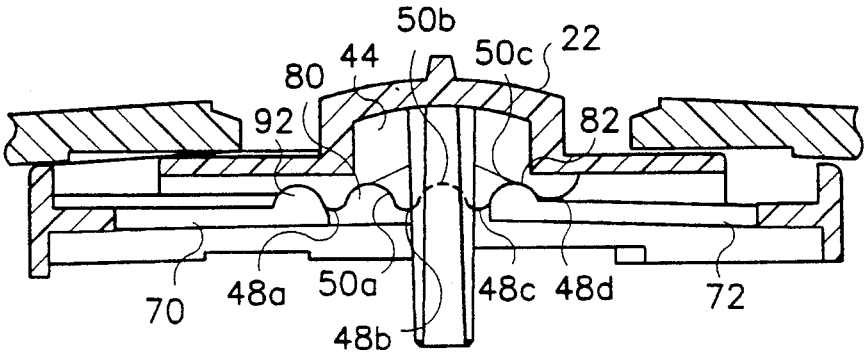
FIG. 6 is a cross-sectional view taken along the line B—B of FIG. 1 showing the actuator in its center position.

In order to move the actuator member 22 from the rightmost position illustrated in FIG. 5 to the center position illustrated in FIG. 6, the cam followers 80, 82 must slide along the cam surface 40. When the actuator member 22 is in the center position illustrated in FIG. 6, the cam follower 80 is positioned within indentation 50*a* and is captured by ridges 48*a*, 48*b*. Similarly, the cam follower 82 is positioned within indentation 50*c* and is captured by adjacent ridges 48*c,d*. The cam follower 92 has not yet contacted the ramp 44. Thus, in order to move the actuator member 22 from the rightmost position illustrated in FIG. 5 to the center position illustrated in FIG. 6, the cam follower 80 must pass over ridge 48*a* and the cam follower 82 must pass over the ridge 48*c*. The resilience of the beams 70, 72 can be overcome only by exerting sufficient force on the actuator member 22 to displace the cam followers 80, 82 over the ridges 48*a,c*, respectively. Thus, a predetermined force must be exerted on the actuator member 22 to move the actuator member 22 from the rightmost switch position to the center switch position.

Figure 7:
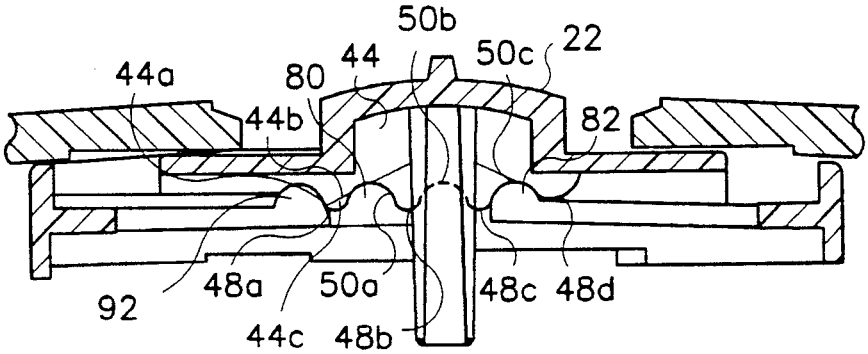
FIG. 7 is a cross-sectional view taken along the line B—B of FIG. 1 showing the actuator moving from its center position to its leftmost position.
Figure 8:
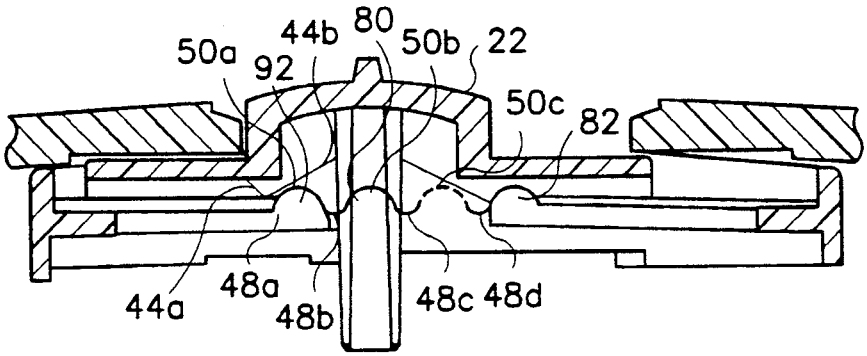
FIG. 8 is a cross-sectional view taken along the line B—B of FIG. 1 showing the actuator in its leftmost or "off" position.

The actuator member 22 is shown moving from the center to the leftmost position in FIG. 7, and it is shown in the leftmost position in FIG. 8. With reference to FIG. 7, in order to move the actuator member 22 to the leftmost position, the cam follower 80 must pass over the ridge 48*b* so that it may be positioned in the indentation 50*a*, as illustrated in FIG. 8. Also, in order for the actuator member 22 to move from the middle position to the leftmost position, the cam follower 82 must pass over the ridge 48*d* to occupy the position illustrated in FIG. 8. The force required to move the actuator member 22 against the force exerted by the cam followers 80, 82 on the cam surface 40 is equal to the force required to move the actuator member 82 between the center and rightmost switch positions. However, the actuator has an asymmetrical detent mechanism to provide an increased force that must be overcome to move the actuator member 22 between the leftmost and center switch positions by the use of the cam follower 92 and ramp 44. Specifically, as illustrated in FIG. 7, as the actuator member 22 moves from the center to the leftmost position, the actuator member 92 contacts the slope 48*a* of the ramp 44. In order to move to the leftmost switch position, the cam follower 92 must pass over the ridge 44*c* formed between the ramp surfaces 44*a,b*. Thus, in order to move the actuator member 22 from the center switch position to the left switch position, it is necessary to overcome not only the restraining force of the cam follows 80, 82 against the cam surface 40, but also the restraining force provided by the cam follower 92 passing over the ridge 44*c*. As a result, it requires substantially more force to move the actuator member 22 between the center and leftmost switch positions than it does to move the actuator member 22 between the center and rightmost switch positions.

It is also important to note that the asymmetrical configuration of the ramp 44 produces asymmetrical force characteristics in moving the actuator member 22 between the leftmost and center switch positions depending upon the direction of movement. Specifically, since the ramp surface 44*a* is steeper than the ramp surface 44*b*, the force required to move the actuator member 22 from the center switch position to the leftmost switch position is greater than the force required to move the actuator member 22 from the leftmost switch position to the center switch position. This configuration makes it possible to rapidly switch the actuator member 22 between the center and rightmost switch positions without inadvertently moving the actuator member 22 to the leftmost switch position.

Although the actuator has been explained with reference only to the cam followers 80, 82 and cam surface 40, it will be understood that the cam followers 94, 96 are interfacing with the cam surface 42 in the same manner. Thus, the force required to move the actuator member 22 from one switch position to an adjacent switch position is four times that which would be required if a single cam follower mounted on a resilient beam was used. As a result, a predetermined actuating force can be obtained by utilizing a substantially smaller and more compact resilient beam than would be required if a single resilient beam was used.

It is important to recognize that the configuration of the cam surfaces 40, 42 on the actuator member 22 is entirely symmetrical about the center of the actuator member 22. In other words, the cam surfaces 40, 42 are identical to each other. Also, ramp 44, 46 is provided on each side of the post 34 even though only one of the ramps 44, 46 is used. As a result, the actuator member 22 can be placed in the recessed portion 62 (FIG. 2) of the support 60 in either direction. This symmetry allows the actuator to be assembled with little chance of improper assembly.

The inventive actuator has been explained with reference to a three-position linear slide switch. However, it will be understood that other configurations may be used. For example, the actuator may be used with slide switches having four or more switch positions by increasing the number of indentations and ridges accordingly. Also, the actuator may be used with a rotary switch by pivotally mounting the actuator, and by using a curved cam surface. Other variations will, of course, be readily apparent to one skilled in the art.

I claim:

1. An actuator for an electrical switch having at least three switch positions, said actuator comprising:

a support;

an actuator member slidably mounted on said support so that said actuator member can slide back and forth between said switch positions;

first detent means for resiliently biasing said actuator member against movement to each of said switch positions; and, second detent means for resiliently biasing said actuator member against movement to less than all of said switch positions so that a force required to move said actuator member to a switch position against only said first detent means is less than a force required to move said actuator member to a switch position against both said first and second detent means.

2. The actuator of claim 1 wherein said actuator member moves in a linear manner along a linear axis of movement between said switch positions.

3. The actuator of claim 2 wherein said first detent means include a first cam surface and a first cam follower resiliently biased against said first cam surface, said first cam surface having a plurality of spaced apart indentations curving away from said first cam follower, the position of each of said indentations corresponding to the position of said actuator member in each of said switch positions.

4. The actuator of claim 3 wherein the indentations of said first cam surface are formed on a surface of said actuator member facing said support, and wherein said first cam follower is a first resilient beam extending from said support beneath said actuator member to contact said first cam surface.

5. The actuator of claim 4 wherein a pair of said first cam surfaces are formed on a surface of said actuator member facing said support, the indentations of each of said first cam surfaces being aligned with each other along a line extending parallel to said axis of movement and equidistant from the center of said actuator member, and wherein a pair of said first resilient beams project from said support to contact said first cam surfaces, respectively, said first resilient beams having respective longitudinal axes that are aligned with the indentations that said first resilient beams contact.

6. The actuator of claim 5 further including a pair of second cam surfaces each having a plurality of indentations formed on the surface of said actuator member facing said support, the indentations of each of said second cam surfaces being aligned with each other along a line extending parallel to said axis of movement, the indentations of each of said second cam surfaces further being aligned with a corresponding indentation in a respective first cam surface along a line extending perpendicular to said axis of movement, said actuator further including a pair of second resilient beams projecting from said support, each of said second resilient beams contacting a respective one of said second cam surfaces, said pair of second resilient beams being positioned at locations that are spaced apart from said pair of first resilient beams along a line extending perpendicular to the axis of movement, each of said second resilient beams being aligned with the indentations of a respective second cam surface that said second resilient beam contacts.

7. The actuator of claim 6 wherein said pairs of first and second cam surfaces are symmetric about a center of said actuator member so that said actuator member may be mounted on said support in either direction.

8. The actuator of claim 3 wherein said second detent means include a second cam surface and a second cam follower resiliently biased against said second cam surface, said second cam surface having a ridge extending toward said second cam follower, said ridge being located so that said second cam follower is positioned on one side of said ridge when said actuator member is in a first switch position and is positioned on the other side of said ridge when said actuator member is in a second switch position adjacent to said first switch position such that said second cam follower must pass over said ridge to move between said first and second switch positions.

9. The actuator of claim 8 wherein said ridge is positioned so that said second cam follower is contacting said ridge when said first cam follower is contacting said first cam surfaces at a location between a pair of adjacent indentations such that movement of said actuator member between the switch positions corresponding to the indentations in said pair of adjacent indentations requires said second cam follower to pass over said ridge and said first cam follower to pass between said adjacent indentations.

10. The actuator of claim 2 wherein said support includes a pair of ridges extending parallel to said axis of movement on opposite sides of said actuator member, said actuator member sliding along said ridges, such that said ridges slidably support said actuator member without allowing said actuator member to move toward and away from said support.

11. The actuator of claim 2 further including a cover mounted over said actuator and said support, said cover having a cutout through which a portion of said actuator projects, said cover having a surface facing said support along which a surface of said actuator member slides as said actuator member moves between said switch positions whereby said cover retains said actuator member in position against said support while allowing said actuator member to slide along said support and said cover.

12. The actuator of claim 2 wherein said actuator member is movable between three switch positions, namely two end positions and an intermediate switch position therebetween, and wherein said second detent means resiliently biases said actuator member against movement to only one of said end switch position so that said actuator member may be moved between the remaining switch positions with relative ease.

13. An actuator for an electrical slide switch having at least three switch positions, said actuator comprising:

a support;

an actuator member slidably mounted on said support so that said actuator member can slide back and forth between said switch positions, said actuator member having formed on a surface facing said support a first elongated cam surface having a plurality of spaced apart ridges, said ridges being aligned along a line that is parallel to a direction of movement of said actuator member when said actuator member is moved between said switch positions, said actuator member further having formed on a surface facing said support a second elongated cam surface having at least one ridge;

a first resilient beam extending from said support to beneath said first cam surface, said first resilient beam terminating in a first cam follower resiliently biased against said first cam surface, the ridges on said first cam surface being positioned with respect to said first cam follower so that said first cam follower passes over a ridge of said first cam surface each time said actuator member moves between adjacent switch positions; and a second resilient beam extending from said support to beneath said second cam surface, said second resilient beam terminating in a second cam follower resiliently biased against said second cam surface, each ridge on said second cam surface being positioned with respect to said second cam follower so that said second cam follower passes over a ridge of said second cam surface only when said actuator member moves between some of said switch positions so that a force required to move said actuator member to other switch positions.

14. The actuator of claim 13 wherein said actuator member further has formed on a surface facing said support a third elongated cam surface extending parallel to said first cam surface, said third cam surface being spaced apart from a central axis of said actuator member by a distance that is equal to and opposite from a spacing of said first cam surface from said central axis, said third elongated cam surface having formed thereon a plurality of spaced apart ridges corresponding in number and position to the ridges of said first cam surface, and wherein said actuator further includes a third resilient beam extending from said support to beneath said third cam surface, said third resilient beam terminating in a third cam follower resiliently biased against said third cam surface, the ridges on said third cam surface being positioned with respect to said third cam follower so that said third cam follower passes over a ridge of said ridge of said third cam surface each time said actuator member moves between adjacent switch positions.

15. The actuator of claim 14 wherein said first and third resilient beams extend from said support member in parallel with each other, and said first and third cam followers are aligned with each other along an axis that is perpendicular to the direction of movement of said actuator member, and wherein the ridges of said first cam surface are aligned with the ridges of said third cam surface along an axis that is perpendicular to the direction of movement of said actuator member.

16. The actuator of claim 15 wherein the ridges of said first and third cam surface are centered about a center of said actuator member so that said actuator member may be positioned on said support in either direction.

17. The actuator of claim 16 wherein said actuator member further includes a pair of spaced apart resilient beams extending from said support to beneath said first and third cam surfaces, respectively, said resilient beams terminating in respective cam followers contacting said first and third cam surfaces, respectively, said cam followers being positioned with respect to the ridges of said first and third cam surfaces that said cam followers pass over said ridges when said actuator member is in the same position that said first and third cam followers pass over the ridges of said first and third cam surfaces, respectively.

18. The actuator of claim 17 wherein said second resilient beam is positioned equidistantly between said first and third beams, and wherein said second cam surface is positioned between said first and third cam surfaces at the center of said actuator member.

19. The actuator of claim 13 wherein a single ridge is formed on said second cam surface, said ridge being located at a position with respect to said second cam follower that said second cam follower passes over said ridge when said actuator member is moved to an end switch position from an adjacent switch position so that said actuator member may be moved between switch position other than said end switch position with relative ease.

20. The actuator of claim 19 wherein said second elongated cam is formed by a pair of ramps intesecting each other to form said single ridge, the ramp that said cam follower initially contacts as said actuator member is moved to said end switch position having a steeper slope than the other of said ramps so that a force required to move said actuator member to said end switch position is greater than a force required to move said actuator member from said end switch position.

21. The actuator of claim 13 wherein said support includes a pair of ridges extending parallel to the direction of movement of said actuator member on oppostie sides of said actuator member, said actuator member sliding along said ridges such that said ridges slidably support said actuator member without allowing said actuator member to move toward and away from said support.

22. The actuator of claim 13 further including a cover mounted over said actuator and said support, said cover having a cutout through which a portion of said actuator projects, said cover having a surface facing said support along which a surface of said actuator member slides as said actuator member moves between said switch positions whereby said cover retains said actuator member in position against said support while allowing said actuator member to slide along said support and said cover.

23. A method of restricting movement of an actuator for an electrical switch having at least three switch positions so that a force required to move said actuator member to some switch positions is greater than a force required to move said actuator member to other switch positions, said method comprising:

restricting movement of said actuator member with a first force as said actuator member moves between each of said switch positions; and restricting movement of said actuator member with a second force as said actuator member moves between less than all of said switch positions so that the force required to move said actuator member to a switch position against only said first force is less than the force required to move said actuator member to a switch position against both said first force and said second force.

* * * * *

UNITED STATES PATENT AND TRADEMARK OFFICE

CERTIFICATE OF CORRECTION

PATENT NO. : 5,122,627

DATED : June 16, 1992

INVENTOR(S) : Roger M. Trana

It is certified that error appears in the above-indentified patent and that said Letters Patent is hereby corrected as shown below:

In column 9, claim 14, line 18, please delete "ridge of said".

In column 9, claim 18, line 48, after "second" please insert -- elongated --.

In column 10, claim 19, line 6, please delete "position" and substitute therefor -- positions --.

Signed and Sealed this

Fourteenth Day of September, 1993

Bruce Lehman

*Attest:*

BRUCE LEHMAN

*Attesting Officer*

*Commissioner of Patents and Trademarks*